US006965345B2

(12) United States Patent
Bae et al.

(10) Patent No.: US 6,965,345 B2
(45) Date of Patent: Nov. 15, 2005

(54) METHOD FOR DESIGNING MULTIBAND ANTENNA USING GENETIC ALGORITHM DEVICE LINKED TO FULL ELECTROMAGNETIC WAVE ANALYZING DEVICE

(75) Inventors: Ji-Hoon Bae, Daegu (KR); Cheol-Sig Pyo, Daejon (KR); You-Chung Chung, Incheon (KR); Jeong-Il Kim, Gyeongsangbuk-do (KR); Jae-Ick Choi, Daejon (KR); Chang-Joo Kim, Daejon (KR)

(73) Assignee: Electronics and Telecommunications Research Institute, (KR)

( * ) Notice: Subject to any disclaimer, the term of this patent is extended or adjusted under 35 U.S.C. 154(b) by 0 days.

(21) Appl. No.: 10/830,991

(22) Filed: Apr. 22, 2004

(65) Prior Publication Data

US 2005/0088343 A1 Apr. 28, 2005

(30) Foreign Application Priority Data

Oct. 22, 2003 (KR) ..... 10-2003-0073933

(51) Int. Cl.[7] ..... H01Q 1/38
(52) U.S. Cl. ..... 343/700 MS
(58) Field of Search ..... 343/700 MS; 364/578, 364/512

(56) References Cited

U.S. PATENT DOCUMENTS 5,719,794 A * 2/1998 Altshuler et al. ..... 703/1
6,175,723 B1 1/2001 Rothwell, III ..... 455/63
6,567,049 B1 * 5/2003 Huang et al. ..... 343/700 MS
2004/0001021 A1 * 1/2004 Choo et al. ..... 343/700 MS

OTHER PUBLICATIONS

IEEE Transactions on Antennas and Propagation, vol. 45, No. 9, Sep. 1997, pp. 1386-1392.
IEEE Transactions on Antennas and Propagation, vol. 47, No. 10, Sep. 1997, pp. 1606-1614.

* cited by examiner

*Primary Examiner*—Hoang V. Nguyen
(74) *Attorney, Agent, or Firm*—Blakely, Sokoloff, Taylor & Zafman

(57) ABSTRACT

Provided is a method for designing multiband antenna using a genetic algorithm unit linked to an electromagnetic wave analyzing unit and to a computer-readable recording medium for recording a program that implements the method. The multiband antenna designing method can design an antenna having an optimal structure by combining a genetic algorithm, one of global optimization techniques, with a full electromagnetic wave analyzing program Quick Finite Difference Time Domain (QFDTD). The method of the present research includes the steps of: a) at the full electromagnetic wave analyzing unit, analyzing an antenna structure contained in an input file and linking the antenna structure to the genetic algorithm unit; b) at the genetic algorithm unit, generating an initial group that expresses the antenna structure; c) at the genetic algorithm unit, evaluating cost functions by using the antenna structure analysis result; and d) at the genetic algorithm unit, designing an antenna by selecting objects based on the cost functions, mating the selected objects and generating mutants.

6 Claims, 3 Drawing Sheets

METHOD FOR DESIGNING MULTIBAND ANTENNA USING GENETIC ALGORITHM DEVICE LINKED TO FULL ELECTROMAGNETIC WAVE ANALYZING DEVICE

FIELD OF THE INVENTION

The present invention relates to a method for designing multiband antenna using a genetic algorithm linked to an electromagnetic wave analyzing program, which is Quick Finite Difference Time Domain (QFDTD).

DESCRIPTION OF RELATED ART

Genetic algorithm is one of global optimization methods. Technologies proposed prior to the present invention include an article by Eric A. Jones, et al., entitled "Design of Yagi-Uda Antennas Using Genetic Algorithms", *IEEE Transaction on Antenna and Propagation,* Vol. 45, No. 9, September, 1997, and U.S. Pat. No. 6,175,723 issued to E. J. Rothwell III, entitled "Self-Structuring Antenna System with a Switchable Antenna Array and an Optimizing Controller".

The article by Eric A. Jones, et al. proposed a method for optimizing the length of the Yagi-Uda antenna. The method optimizes the array space and length of elements so that the gain and impedance matching could be optimized by a genetic algorithm linked with Numerical Electromagnetic Code (NEC), which is one of widely-used full electromagnetic wave analyzing program.

However, the technology has problems. The shapes of antennas that can be optimized are limited because the NEC is based on wire grid, and the complexity of computation and the time for optimization are increased if frequency band analysis is increased such as multiband. In addition, NEC program is not suitable for a patch antenna design.

On the other hand, the U.S. Pat. No. 6,175,723 discloses an antenna whose wires are arrayed alternately with each other and the array structure is varied adaptively according to the intensity of a signal received at a receiving unit by turning on or off the physical switches connected to the wires electrically.

When the wire array structure is optimized, the power-on state of a switch is defined as "1", while the power-off state of the switch is defined as "0". The definitions are encoded into binary numbers and then applied to a genetic algorithm.

Since the antenna with the above-mentioned structure uses the electrical power-on/off states of physical switches, it requires many switches to perform diverse functions of antenna optimally. Therefore, it is difficult to miniaturize the antenna and reduce production cost.

SUMMARY OF THE INVENTION

It is an object of the present invention to provide a method for designing/optimizing a multiband antenna using a genetic algorithm linked to a full electromagnetic wave analyzing program. The genetic algorithm is linked with a full electromagnetic wave analyzing program, Quick Finite Difference Time Domain (QFDTD).

It is another object of the present invention to provide a computer-readable recording medium for recording a program that implement the method for designing an antenna having an optimal structure by combining the genetic algorithm with the QFDTD.

In accordance with an aspect of the present invention, there is provided a method for designing a multiband antenna using a genetic algorithm linked to a full electromagnetic wave analyzing unit, the method including the steps of: a) at the full electromagnetic wave analyzing unit, analyzing an antenna structure contained in an input file and linking the antenna structure to the genetic algorithm unit; b) at the genetic algorithm unit, generating an initial group that expresses the antenna structure; c) at the genetic algorithm unit, evaluating cost functions by using the antenna structure analysis result; and d) at the genetic algorithm unit, designing an antenna by selecting objects based on the cost functions, mating the selected objects and generating mutants.

In accordance with another aspect of the present invention, there is provided a method as recited in claim 1, further including a step of: e) if the selected object does not satisfy a design condition, forming a new group and repeating the steps c) and d).

In accordance with another aspect of the present invention, there is provided a computer-readable recording medium for recording a program that implements an antenna designing method in an antenna designing apparatus provided with a microprocessor, the method including the steps of: a) at the full electromagnetic wave analyzing unit, analyzing an antenna structure contained in an input file and linking the antenna structure to the genetic algorithm unit; b) at the genetic algorithm unit, generating an initial group that expresses the antenna structure; c) at the genetic algorithm unit, evaluating cost functions by using the antenna structure analysis result; and d) at the genetic algorithm unit, designing an antenna by selecting objects based on the cost functions, mating the selected objects and generating mutants.

In accordance with another aspect of the present invention, there is provided a method as recited in claim 1, further including a step of: e) if the selected object does not satisfy a design condition, forming a new group and repeating the steps c) and d).

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

Figure 1:
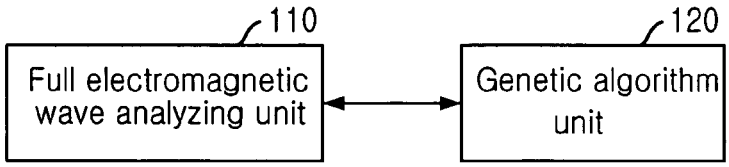
FIG. 1 is a block diagram showing a multiband antenna designing apparatus to which the present invention is applied.

Other objects and aspects of the invention will become apparent from the following description of the embodiments with reference to the accompanying drawings, which is set forth hereinafter. The same reference numeral is given to the same element, although the element appears in different drawings. Hereafter, preferred embodiments of the present invention will be described in detail with reference to the drawings.

FIG. 1 is a block diagram showing a multiband antenna designing apparatus to which the present invention is applied. Referring to FIG. 1, the antenna designing apparatus of the present invention includes a full electromagnetic wave analyzing unit 110 and a genetic algorithm unit 120.

The full electromagnetic wave analyzing unit 110 has ASCII input and/or output file formats which have an easy input and/or output link to other software. It can perform package processing for analyzing a multiband antenna and it can use a Quick Finite Difference Time Domain (QFDTD) which can analyze two or three-dimensional structures.

Here, the QFDTD is an analyzing tool based on a Finite-Difference-Time-Domain (FDTD) algorithm, which is a full electromagnetic wave analyzing program.

Figure 2:
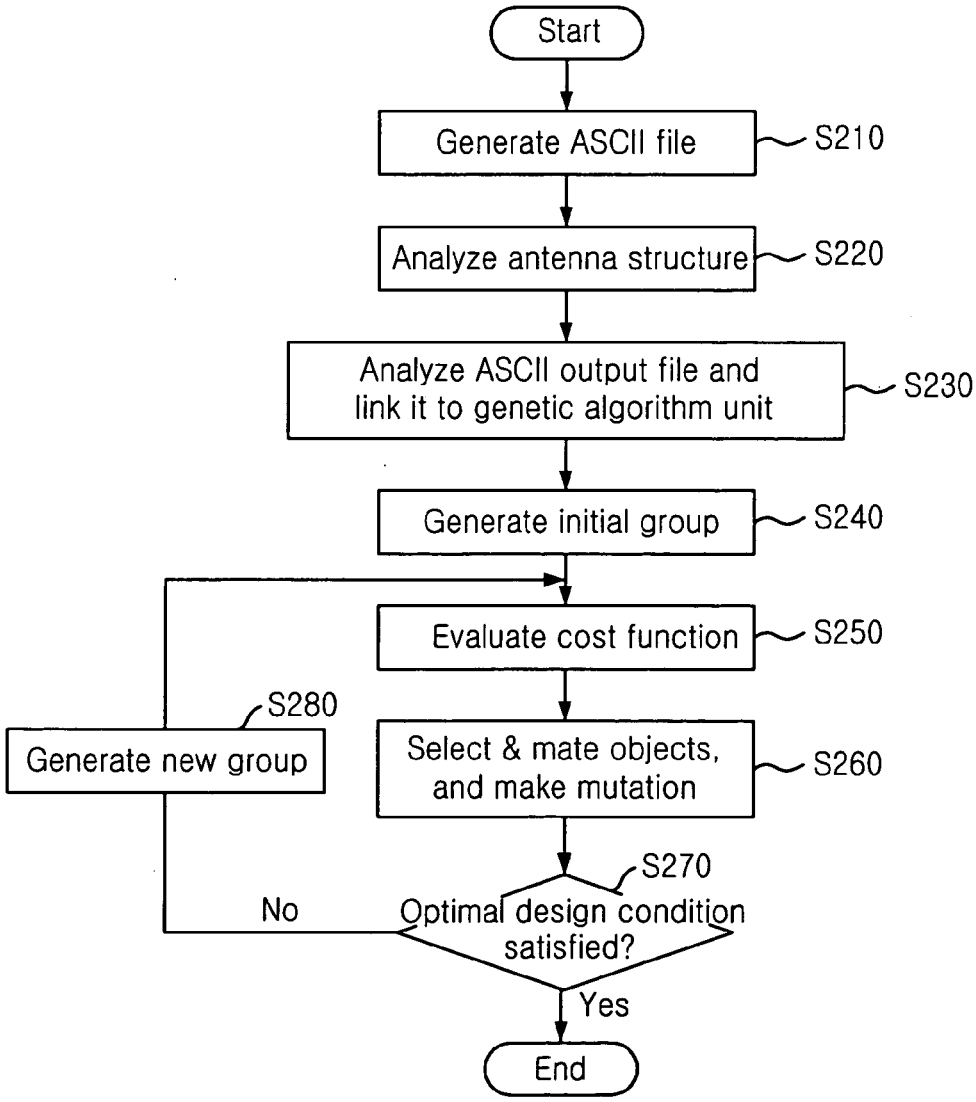
FIG. 2 is a flowchart describing a method for designing a multiband antenna using a genetic algorithm unit linked to a full electromagnetic wave analyzing unit in accordance with an embodiment of the present invention.

FIG. 2 is a flowchart describing a method for designing a multiband antenna using a genetic algorithm unit linked to a full electromagnetic wave analyzing unit in accordance with an embodiment of the present invention. Referring to FIG. 2, the antenna designing method will be described hereafter. First, at step S210, an ASCII input file with an antenna patch shape printed on a two-dimensional plane is generated to execute the full electromagnetic wave analyzing unit 110. The input file can include other antenna shapes except the patch.

At step S220, the full electromagnetic wave analyzing unit 110 analyzes a given antenna structure according to the input file. After analysis, at step S230, an ASCII output file which is a simulation result of the full electromagnetic wave analyzing unit 110 is analyzed and the result is linked to the optimization procedure of the genetic algorithm unit 120.

At step S240, the genetic algorithm unit 120 generates an initial group that expresses an antenna structure encoded into binary numbers. Then, at step S250, a cost function for each of the objects that constitute the initial group is evaluated by using the antenna structure analysis result of the full electromagnetic wave analyzing unit 110 linked to the genetic algorithm unit 120.

The cost function can be calculated by adding other analysis results except the analysis result for return loss (S-parameter) of multiband frequency areas. The generation limit of repetition number, size of population, and pattern can be added to the analysis results.

Subsequently, at step S260, objects are selected and mated based on the evaluated cost functions and mutants are applied to a new group. Following is detailed description on the mutation.

The genetic algorithm unit 120 gives priority order to each of the objects of the initial group based on the evaluated cost functions, lines up the objects from the best to the worst and abandons the worse half of the initial group. This process is called object selecting.

The genetic algorithm unit 120 generates a new offspring group through mating by using a mating operator. The offspring group replaces the abandoned group. After the new group is generated, a mutation operator is applied to the new group to thereby generate mutants.

At step S270, if an optimal design condition is not satisfied, at step S280, a new group is generated and the processes of the steps S250 and S260 is carried out repeatedly by using the linked full electromagnetic wave analyzing program.

That is, the processes of selecting a new group, evaluating cost functions, operating selection, operating mating, and operating mutation are performed repeatedly until the purpose of designing an optimal antenna structure is achieved.

Figure 3:
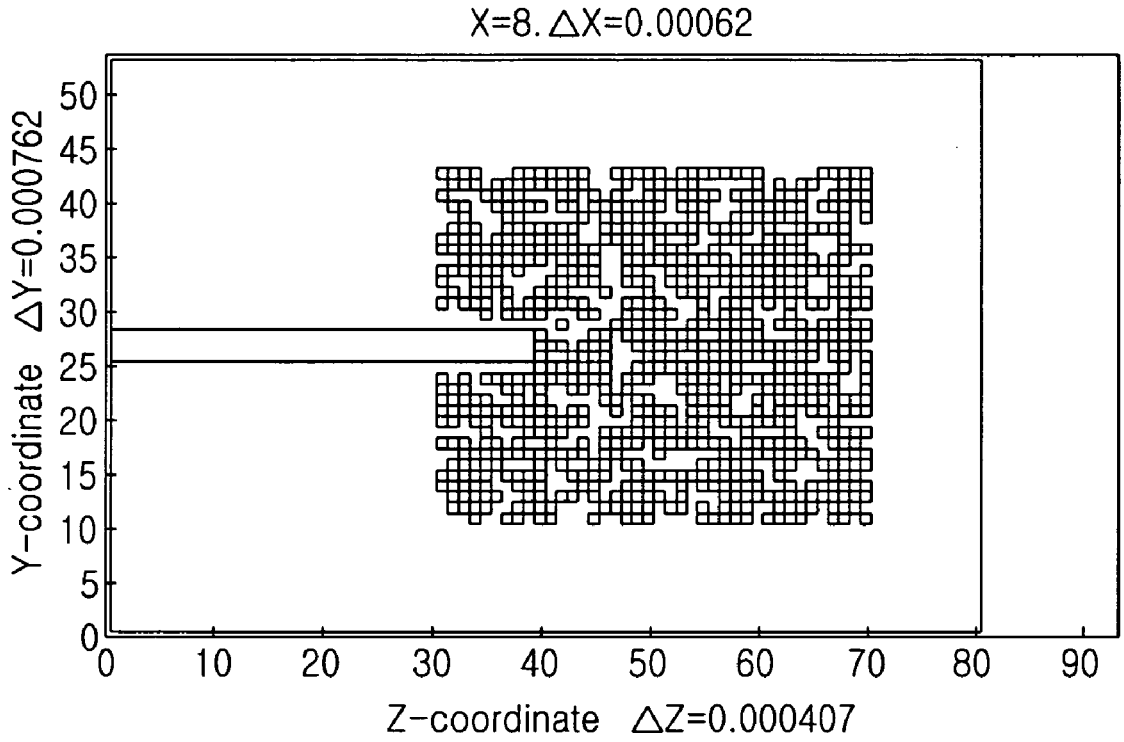
FIG. 3 is a graph depicting an optimized patch antenna which is designed in accordance with an embodiment of the antenna designing method of the present invention.
Figure 4:
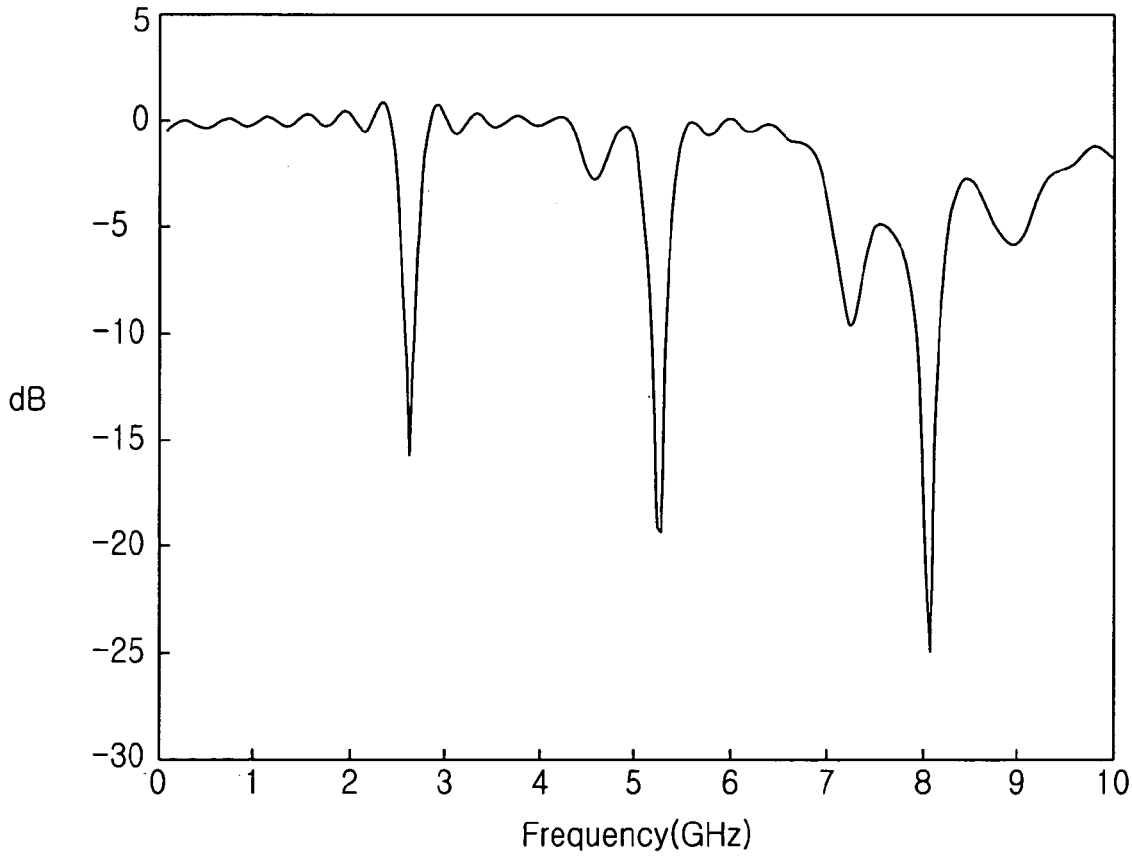
FIG. 4 is a graph describing return loss characteristic of the antenna structure in FIG. 3.

FIG. 3 is a graph depicting an optimized patch antenna which is designed in accordance with an embodiment of the antenna designing method of the present invention. FIG. 4 is a graph describing return loss characteristic of the antenna structure in FIG. 3.

Referring to the drawing, the antenna designed in accordance with the present invention maintains fine return loss characteristic in multibands 2.4 GHz, 5.2 GHz, 5.7 GHz and 8.5 GHz.

The fine return loss characteristic and other analysis results can be added to the cost functions and applied to the designing of an antenna structure.

The antenna designing method of the present invention can be embodied as a program and stored in a computer-readable recording medium, such as CR-ROM, RAM, ROM, floppy disks, hard disks, magneto-optical disks, and the like.

The antenna designing method of the present invention can design an antenna having an optimal two or three-dimensional structure by combining a genetic algorithm, one of global optimization techniques, with the Quick Finite Difference Time Domain (QFDTD), which is a full electromagnetic wave analyzing program and design an antenna with diverse functions.

While the present invention has been described with respect to certain preferred embodiments, it will be apparent to those skilled in the art that various changes and modifications may be made without departing from the scope of the invention as defined in the following claims.

What is claimed is:

1. A method for designing a multiband antenna using a genetic algorithm linked to a full electromagnetic wave analyzing unit, the method comprising the steps of:

a) at the full electromagnetic wave analyzing unit, analyzing an antenna structure contained in an input file and linking the antenna structure to the genetic algorithm unit;

b) at the genetic algorithm unit, generating an initial group that expresses the antenna structure;

c) at the genetic algorithm unit, evaluating cost functions by using the antenna structure analysis result; and d) at the genetic algorithm unit, designing an antenna by selecting objects based on the cost functions, mating the selected objects and generating mutants.

2. The method as recited in claim 1, further comprising the step of:

e) if the selected object does not satisfy a design condition, forming a new group and repeating the steps c) and d).

3. The method as recited in claim 1, wherein the step a) includes the steps of:

a1) generating an ASCII input file having an antenna structure;

a2) at the full electromagnetic wave analyzing unit, analyzing the antenna structure in the ASCII input file to generate an ASCII output file; and a3) at the full electromagnetic wave analyzing unit, analyzing the ASCII output file and linking the analysis result to the genetic algorithm unit.

4. The method as recited in claim 1, wherein the cost functions of the step c) are evaluated based on return loss in the multiband frequency areas, generation limit of repetition number, size of sample population and pattern.

5. The method as recited in claim 1, wherein the step d) includes the steps of:

d1) giving a priority order to each of the object based on the cost functions, lining up the objects from the best to the worst, and abandoning the worse half of the lined objects;

d2) generating an offspring group by using a mating operator, and substituting the offspring group for the abandoned group of the step d1); and d3) designing an antenna by applying a mutation operator to the group generated in the step d2).

6. A computer-readable recording medium for recording a program that implements an antenna designing method in an antenna designing apparatus provided with a microprocessor, the method comprising the steps of:

a) at the full electromagnetic wave analyzing unit, analyzing an antenna structure contained in an input file and linking the antenna structure to the genetic algorithm unit;

b) at the genetic algorithm unit, generating an initial group that expresses the antenna structure;

c) at the genetic algorithm unit, evaluating cost functions by using the antenna structure analysis result; and d) at the genetic algorithm unit, designing an antenna by selecting objects based on the cost functions, mating the selected objects and generating mutants.

* * * * *